US006241648B1

(12) United States Patent
Uera et al.

(10) Patent No.: US 6,241,648 B1
(45) Date of Patent: Jun. 5, 2001

(54) SIGNATURE-DELIVERY-PITCH REGULATING APPARATUS FOR A DELIVERY APPARATUS OF A FOLDING MACHINE

(75) Inventors: Yoshinori Uera; Kazuyuki Motojima, both of Kawasaki; Noritake Harada, Yokohama, all of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/249,115

(22) Filed: Feb. 12, 1999

(30) Foreign Application Priority Data

May 26, 1998 (JP) ..... 10-159998

(51) Int. Cl.[7] ..... B31F 1/08; B65H 29/20

(52) U.S. Cl. ..... 493/424; 271/69; 271/202; 271/204; 271/315

(58) Field of Search ..... 493/424, 444, 493/445, 434, 435, 436; 271/315, 69, 307, 178, 202, 204, 205, 206, 216

(56) References Cited

U.S. PATENT DOCUMENTS 4,545,782 * 10/1985 Niemiro et al. ..... 493/444
5,261,656 * 11/1993 Gutov et al. ..... 271/204
5,388,820 * 2/1995 Eberle et al. ..... 271/204
5,690,328 * 11/1997 Herda et al. ..... 271/315
5,722,655 * 3/1998 Reist ..... 271/216

FOREIGN PATENT DOCUMENTS 58-114250 8/1983 (JP) .
3032498 9/1996 (JP) .

* cited by examiner

*Primary Examiner*—Peter Vo
*Assistant Examiner*—Christopher R Harmon
(74) *Attorney, Agent, or Firm*—Armstrong, Westerman, Hattori, McLeland & Naughton, LLP

(57) ABSTRACT

A signature-delivery-pitch regulating apparatus includes a grip mechanism adapted to grip a signature received in a rotating delivery fan, push the signature out of the delivery fan, and then release the signature on the transport conveyer operating at a speed slower than the moving speed of the grip mechanism. The grip mechanism includes at least one endless chain in meshing engagement with at least a first sprocket and a second sprocket. The first sprocket rotates at a position within a rotation locus of bottoms of signature receiving spaces of the delivery fan and in the vicinity of a region where the delivery fan comes close to the transport conveyer. The second sprocket has an outer circumference located outside the rotation region of the delivery fan. The endless chain can travel along the transport direction of the transport conveyer from a position inside the rotation region of the delivery fan to a position outside the rotation region of the delivery fan. Each pair of first and second grip members provided on different links of the endless chain at a constant pitch is opened and closed in order to grip and release the signature. The endless chain travels at a speed slower than the circumferential speed of the delivery fan.

6 Claims, 4 Drawing Sheets

SIGNATURE-DELIVERY-PITCH REGULATING APPARATUS FOR A DELIVERY APPARATUS OF A FOLDING MACHINE

BACKGROUND OF THE INVENTION

1. Field of the Invention

The present invention relates to a delivery apparatus in which signatures—each of which is cut and folded at a folding section of a folding machine of a rotary press and is received by a delivery fan—are placed on a transport conveyer disposed under the delivery fan such that the signatures overlap each other at a constant pitch and are delivered to the outside of the folding machine through operation of the transport conveyer, and more particularly to a signature-delivery-pitch regulating apparatus capable of causing a grip mechanism to grip each of signatures received by the delivery fan, while the signature is rotated and transported by the delivery fan, and capable of subsequently causing the grip mechanism to release the signature on the transport conveyer such that signatures are aligned on the transport conveyer at a constant pitch.

2. Description of the Related Art

Japanese Utility Model Registration No. 3032498 discloses an example of a signature-delivery-pitch regulating apparatus for a delivery apparatus of a folding machine, in which a grip mechanism grips each of signatures received by the delivery fan, while the signature is rotated and transported by the delivery fan, and releases the signature on the transport conveyer such that signatures are aligned on the transport conveyer at a constant pitch.

The conventional apparatus includes an endless chain that can be displaced from the inside of a rotary region of the delivery fan to the outside thereof, and a grip mechanism for gripping a signature is provided on each chain link of the endless chain. The grip mechanism grips a signature received by the delivery fan, pushes the signature out of the delivery fan while maintaining the gripped state, and releases the pushed-out signature onto the transport conveyer.

The grip mechanism provided on each chain link of the endless chain is composed of a first grip member and a second grip member. The first grip member is formed by the forward-side end portion of the chain link with respect to the direction of displacement of the chain. Specifically, the forward-side end portion of the chain link is bent perpendicularly to form the first grip member. The second grip member is swingably supported by a support shaft disposed at a central portion of the chain link in parallel with chain-link connection pins. The second grip member has at its one end a portion that faces the first grip member. Therefore, through swing movement of the second grip member, the opposed portion of the second grip member comes into contact with and separates from the first grip member.

Further, the second grip member is urged by means of a torsion coil spring in such a direction that the opposed portion of the second grip member separates from the first grip member in order to open the grip mechanism.

The other end of the second grip member is projected to the side of the chain link opposite the side to which the first grip member extends. The projected portion of the second grip member serves as an operation portion for bringing the opposed portion of the second grip member into contact with the first grip member against the force of the torsion coil spring to thereby close the grip mechanism.

Further, a stationary cam is provided. This stationary cam interferes with the operation portion of the second member, so that the grip mechanism is closed in a predetermined section while the endless chain travels. When the stationary cam interferes with the operation portion of the second grip member, the locus of the endless chain may expand outward due to the force of the torsion coil spring, resulting in incomplete closure of the grip mechanism. Therefore, a chain guide is provided in order to suppress the expansion of the locus of the endless chain.

The signature-delivery-pitch regulating apparatus disclosed in Japanese Utility Model Registration No. 3032498 has the following drawbacks to be solved.

In the apparatus, since the grip mechanism is composed of a first grip member, which is constituted by a perpendicularly-bent-portion of a chain link, and a second grip member attached to the chain link, the depth of the grip mechanism cannot be increased. Therefore, the grip mechanism can grip each signature over only a short distance, so that the grip mechanism tends to drop the gripped signature. Especially, when the grip mechanism grips a thick signature, the possibility of dropping the signature increases.

In the apparatus, as the delivery fan rotates, a signature enters the grip mechanism in a direction substantially parallel to the first grip member. The tip end of the entered signature is received and stopped by the outer circumferential edge of the chain link in a state in which the signature hits the outer circumferential edge at a substantially right angle. Therefore, after hitting, the signature is driven back, resulting in a further decreased grip distance and incomplete gripping.

Therefore, the above-described conventional apparatus lacks reliability in regulating signature delivery pitch.

Further, in the conventional apparatus, the grip mechanism is normally brought into an opened state by the torsion coil spring, and when the grip mechanism is to be closed, the operation portion of the second grip member is caused to interfere with the stationary cam to thereby swing against the force of the torsion coil spring, so that the portion of the second grip member facing the first grip member comes into contact with the first grip member. Therefore, breakage of the torsion coil spring and wear of the support portion of the second grip member tend to occur easily, resulting in improper operation.

Further, in order to functionally operate the grip mechanism, the stationary cam—which forcibly close the second grip member against the force of the torsion coil spring—must be accurately provided at a predetermined position. Further, since the state of interference between the stationary cam and the second grip member must be maintained constant, the entire apparatus, including the grip mechanism, becomes complex and must have a high degree of accuracy.

In addition, while the stationary cam interferes with the operation portion of the second grip member, the two members come into rubbing contact with each other with a strong force, so that at least one of the members wears. Therefore, the worn member must be replaced with a new one at regular intervals in order to maintain the performance of the apparatus.

Accordingly, the above-described conventional apparatus requires a large number of steps in machining and assembly, as well as cumbersome maintenance and adjustment. In addition, manufacturing cost and running cost are both very high, partly due to the complicated shape of the chain links.

SUMMARY OF THE INVENTION

An object of the present invention is to provide a signature-delivery-pitch regulating apparatus in which each grip mechanism has an increased depth and therefore can reliably grip a signature over an increased grip distance, and which therefore can reliably regulate signature delivery pitch.

Another object of the present invention is to provide a signature-delivery-pitch regulating apparatus which is simple in terms of mechanism and therefore can be easily machined and assembled, and in which a very strong force does not act on the component members and therefore breakage or wear of the component members hardly occurs, so that the frequency of maintenance and adjustment can be minimized.

The signature-delivery-pitch regulating apparatus of the present invention is used for a delivery apparatus of a folding machine of a rotary press, which delivery apparatus comprises a delivery fan, a grip mechanism, and a transport conveyer. The delivery fan is adapted to receive signatures folded in the folding section at a plurality of signature receiving spaces while rotating. The grip mechanism is adapted to grip a signature in each signature receiving space, push the signature out of the signature receiving space, move toward the transport conveyer, and then release the signature on the transport conveyer. The transport conveyer operates at a speed that has a predetermined relationship with the moving speed of the grip mechanism. The grip mechanism comprises at least one endless chain, a plurality of first grip members, a plurality of second grip members, and drive means. The endless chain is in meshing engagement with at least a first sprocket and a second sprocket. The first sprocket has a rotation center within a rotation locus of bottoms of the signature receiving spaces of the delivery fan and in the vicinity of a region where the delivery fan comes close to the transport conveyer. The outer circumference of the second sprocket is located outside the rotation region of the delivery fan. The endless chain can travel along the transport direction of the transport conveyer from a position inside the rotation region of the delivery fan to a position outside the rotation region of the delivery fan. The plurality of first grip members are provided on different links of the endless chain at a constant pitch. The plurality of second grip members are provided on the endless chain at a constant pitch such that each second grip member is located between the first grip members and fixed to a link different from the link to which the first grip member is attached. A free end of the second grip member can be brought into contact with or separated from the first grip member located on the upstream side with respect to the travel direction of the endless chain. Thus, the second grip member cooperates with the first grip member to grip and release the signature. The drive means causes the endless chain to travel at a speed slower than the circumferential speed of the delivery fan, while maintaining a predetermined relationship with the circumferential speed of the delivery fan.

At a position where the endless chain starts to curve along each sprocket, the second grip member opens relative to the first grip member. At a position where the endless chain ends traveling along each sprocket, the endless chain becomes straight so that the second grip member closes relative to the first grip member. Further, when the endless chain travels along the first sprocket, the second grip member opens relative to the first grip member, the opening is located on the rotary locus of the bottoms of the signature receiving spaces of the delivery fan. As the deliver fan rotates, the signature enters the space between the first and second grip members. In this state, the travel of the endless chain along the first sprocket ends, and the second grip member is closed relative to the first grip member.

Further, there may be provided a chain support mechanism for supporting the endless chain to thereby prevent downward slack in a region between the first and second sprockets where the endless chain travels along the transport direction of the transport conveyer.

Also, at least one of the first and second grip members may be supported on the endless chain via an elastic member. Alternatively, at least one of the first and second grip members may be formed of an elastic material. In this case, the signature can be gripped by the first and second grip members regardless of the thickness of the signature.

In the signature-delivery-pitch regulating apparatus for a delivery apparatus of a folding machine, a signature can be reliably gripped over a long grip distance. Therefore, the signature-delivery-pitch regulating apparatus can reliably regulate the overlap pitch of signatures that are delivered from a rotary press; i.e., can reliably regulate the delivery pitch of the signatures.

Further, the mechanism and structure, especially the structure of the signature grip mechanism, can be simplified considerably. Therefore, the apparatus of the present invention can be easily machined and assembled, and the frequency of breakdown and production costs can be decreased.

Further, since a very strong force does not act on the component members whether the apparatus is in a stopped state or in an operating state, breakage or wear of the component members hardly occurs, so that the frequency of breakdown becomes considerably low.

As a result, in cooperation with the above-described simplified structure, maintenance and adjustment become very easy, the frequency of maintenance and adjustment can be minimized, and running cost can be reduced.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

With reference to the drawings, there will be described a signature-delivery-pitch regulating apparatus for a delivery apparatus of a folding machine according to an embodiment of the present invention.

Figure 1:
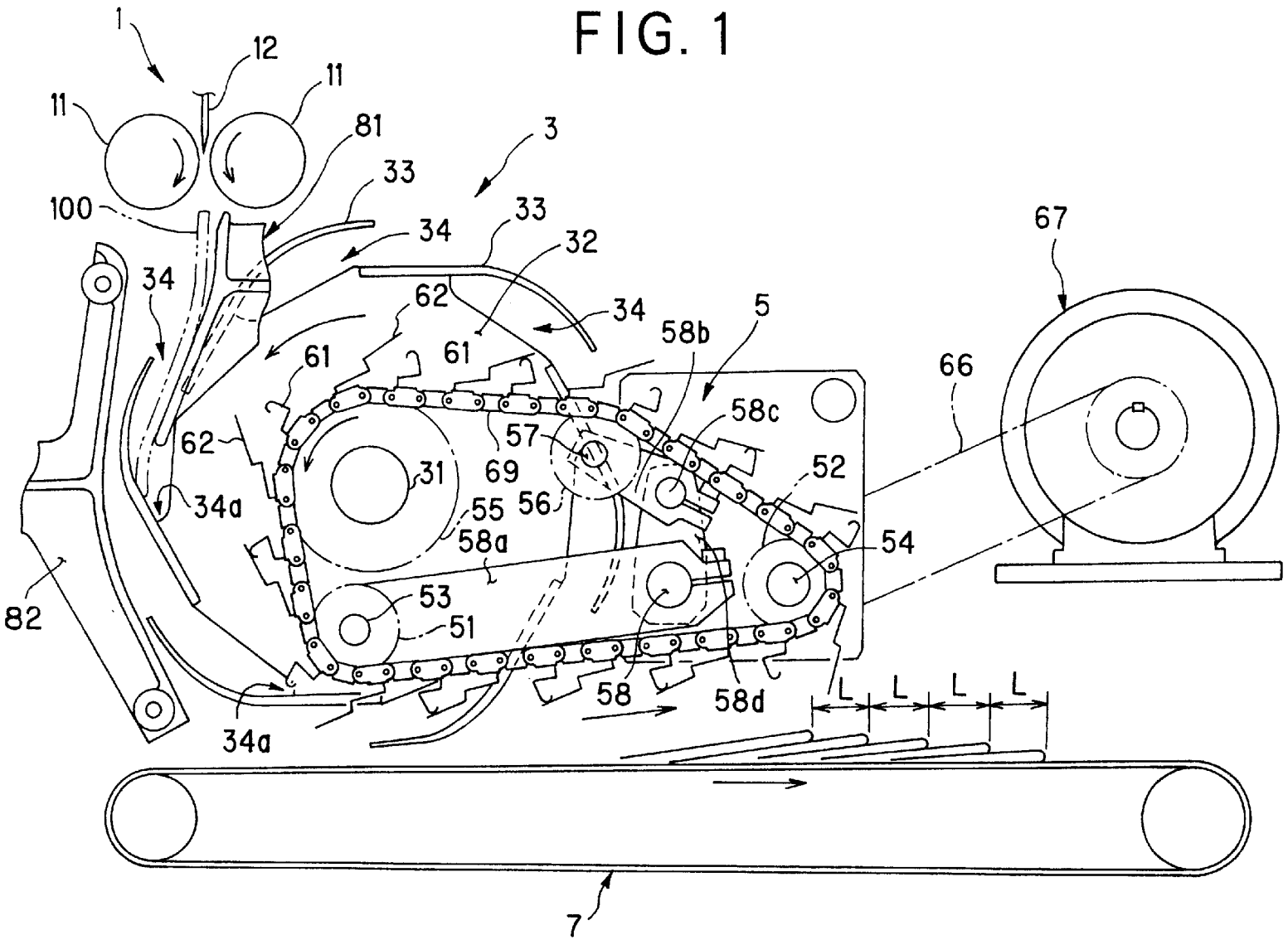
FIG. 1 shows a signature-delivery-pitch regulating apparatus for a delivery apparatus of a folding machine according to an embodiment of the present invention.
Figure 2:
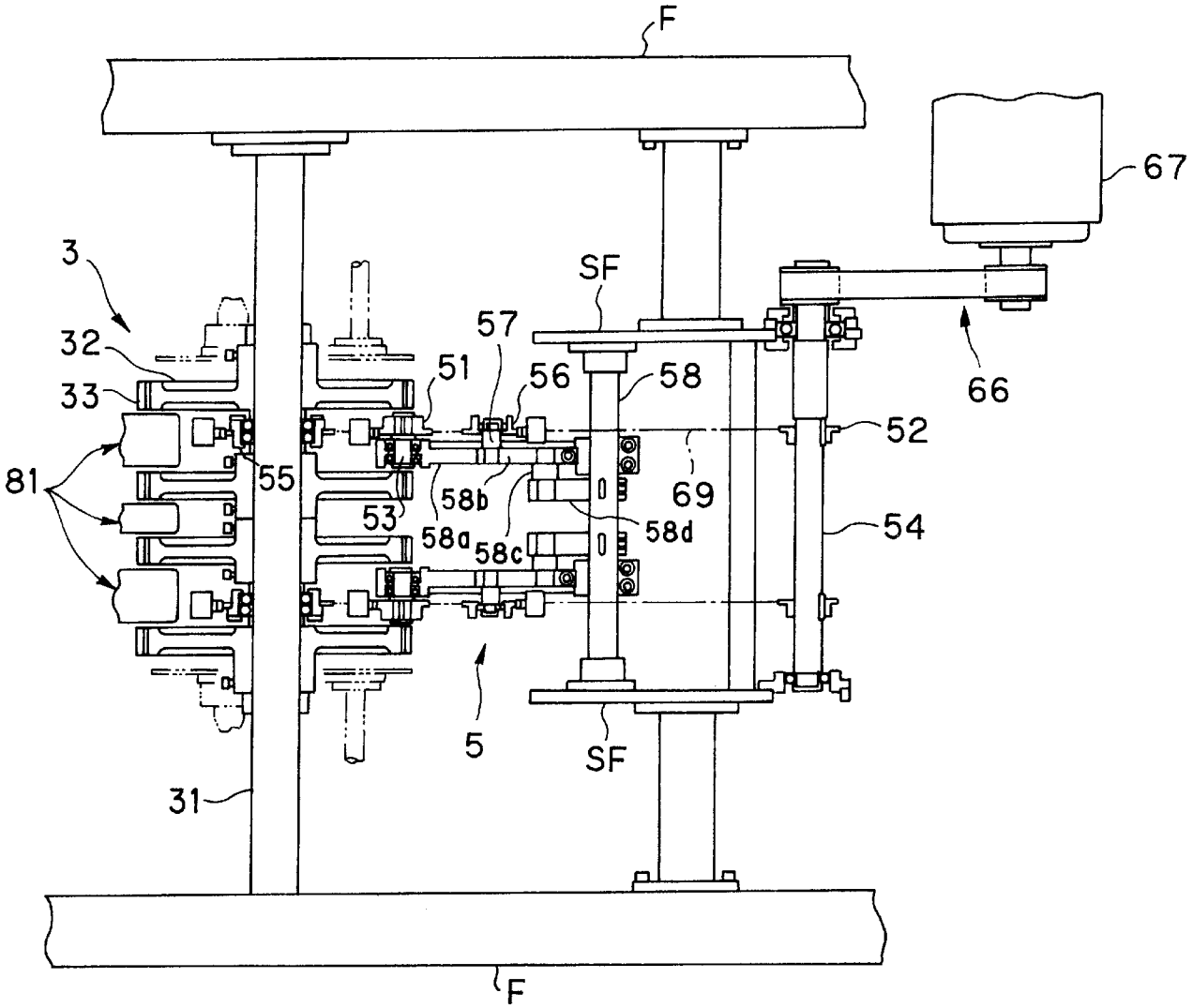
FIG. 2 is a partially sectioned plan view of the apparatus of FIG. 1.

As shown in FIGS. 1 and 2, a holding section 1 is composed of a pair of rollers 11 and a blade 12. The rollers 11 are rotatably supported on an unillustrated frame and are driven to rotate. The blade 12 extends along the axial direction of the rollers 11 and can enter a clearance formed between the outer circumferential surfaces of the rollers 11. The blade 12 engages with a folding portion of paper at which the paper is to be folded and enters the clearance formed between the outer circumferential surfaces of the rollers 11 in order to insert the folding portion of paper into the clearance between the rollers 11.

Below the folding section 1 is disposed a delivery fan 3 which receives signatures 100 that have been folded at and discharged from the folding section 1.

In the delivery fan 3, the opposite ends of a rotary shaft 31 are supported on frames F and the rotary shaft 31 is driven by an unillustrated drive mechanism such that the rotary shaft 31 rotates synchronously with rotation of the folding section 1. A predetermined number of (four in the illustrated example) disc members 32 are attached to the rotary shaft 31 in an axially spaced manner. Each of the disc members 32 has a predetermined number of arcuate fan members radially provided on the outer circumference at constant intervals.

The disc member 32 has a substantially regular polygonal shape (dodecagon in the illustrated example), and the base portions of the fan members 33 are attached to alternate sides of the disc member 32 such that the tip end portion of each fan member 33 extends toward the upstream side with respect to the rotational direction of the disc member 32. Thus, a signature receiving space 34 is formed between a side of the disc member 32 on which the fan member 33 is not attached and the inner surface of the fan member 33 attached to an adjacent side of the disc member 32 located on the downstream side with respect to the rotational direction. The fan members 33 of the four disc members 32 are in the same phase in the rotational direction.

In the vicinity of the bottom 34*a* of each signature receiving space 34, the corresponding side of the disc member 32 that forms the signature receiving space 34 is slightly cut and removed in the radial direction in order to widen the signature receiving space 34 up to the bottom 34*a*. Therefore, the signature receiving space 34 can accommodate a signature 100 having a large thickness.

The position of the disc members 32 or the rotary shaft 31 is determined such that the opening of one of the signature receiving spaces 34 is located below the clearance between the outer circumferential surfaces of the rollers 11 of the folding section 1.

A transport conveyer 7 is disposed under the delivery fan 3. The transport conveyer 7 extends horizontally toward the downstream side with respect to the rotational direction of the delivery fan 3 in a lower-side region (to the right in FIG. 1). The transport conveyer 7 is driven by unillustrated drive means to transport signatures in the direction of extension. Further, there is disposed a grip mechanism 5 which transports signatures 100 from the delivery fan 3 to the transport conveyer 7.

The grip mechanism 5 has a pair of sub frames SF which are fixed to the insides of the frames F to be located above the transport conveyer 7 at the downstream side thereof. The sub frames SF are located in regions outside the disc members 32 and the fan members 33 provided at the opposite sides of the delivery fan 3. The sub frames SF support the opposite ends of the support shaft 58. A single or plurality of arms 58*a*, whose base ends are attached to the support shaft 58, extend into spaces formed between the disc members 32 that are axially adjacent to each other. That is, when a single arm 58*a* is provided, the arm 58*a* extends into a space located at an axially center position. In the case of the illustrated example where two arms 58*a* are provided, the arms 58*a* extend into spaces adjacent to the outermost disc members 32. A rotary shaft 53 of a first sprocket 51 is supported at the tip end of each arm 58*a* via a rolling bearing.

The first sprocket 51 is located inside the rotation locus of the bottoms 34*a* of the signature receiving spaces 34 and in the vicinity of a region where the outer circumferential surface of the delivery fan 3 and the transport conveyer 7 come close to each other.

Further, the sub frames SF support the opposite ends of a rotary shaft 54 via rolling bearings such that the rotary shaft 54 is located on the downstream side of the support shaft 58 with respect to the transport direction of the transport conveyer 7. One end of the rotary shaft 54 is projected outside one of the sub frames SF, and a toothed pulley is attached to the projected end.

An electric motor 67 whose rotation is properly controlled by unillustrated control means is disposed at a proper position, and is adapted to rotate the rotary shaft 54 via a toothed-belt transmission mechanism 66. To the rotary shaft 54 are attached two second sprockets 52 at axial positions corresponding to those of the first sprockets 51.

Further, intermediate sprockets 55 are attached to the rotary shaft 31 at locations between adjacent disc members 32. In the illustrated example, two intermediate sprockets 55 are attached to the rotary shaft 31 via rolling bearings such that they are located adjacent to the outermost disk members 32 in order to correspond to the first sprockets 51.

An endless chain 69 is wound around each set comprising one of the first sprockets 51, one of the second sprockets 52, and one of the intermediate sprockets 55 that are located at the same axial position. In the illustrated example, two endless chains 69 are provided. In a region between the first sprockets 51 and the second sprockets 52, the endless chains 69 travel above the transport conveyer 7 substantially parallel to the transport direction of the transport conveyer 7 and toward the transport direction of the transport conveyer 7 (to the right in FIG. 1).

Preferably, a chain-tension sprocket 56 for eliminating harmful slack of the endless chain 69 is provided between the corresponding second sprocket 52 and intermediate sprocket 55. A support shaft 57 rotatably supporting the chain-tension sprocket 56 is attached to one end of an arm 58*d*, the other end of which is attached to one end of another arm 58*d* via a support shaft 58*c*. The other end of the arm 58*d* is fixed to the support shaft 58. The tension that the chain-tension sprocket 56 applies to the corresponding endless chain 69 is adjusted through proper setting of the fixing angle of the arm 58*b* relative to the support shaft 58*c* as well as the fixing angle of the arm 58*d* relative to the support shaft 58.

Figure 3:
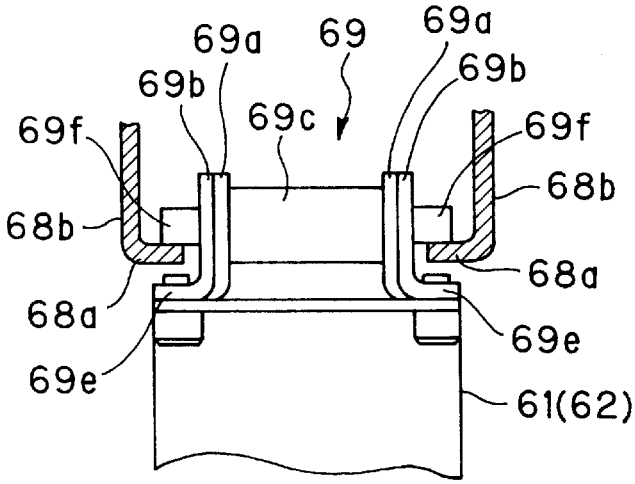
FIG. 3 is a cross-sectional view showing the relationship between an endless chain and an endless chain support mechanism used in the signature-delivery-pitch regulating apparatus of FIG. 1.

As shown in FIG. 3, each of the endless chains 69 is formed from inner links 69*a*, outer links 69*b*, rollers 69*c*, and pins 69*d*. More specifically, the end portions of two pairs of the adjacent inner and outer links 69*a* and 69*b* sandwich opposite end surfaces of a roller 69*c* and are connected to each other via a pin 69*d* penetrating the roller 69*c*. Each of the inner and outer links 69*a* and 69*b* has a flange portion 69*e* and therefore has an L-shaped cross section. The flange portion 69*e* projects outward at the outer circumferential side of the chain, and the opposite ends 69*f* of each pin 69*d* project from the outer links 69*b*.

Paired first and second grip members 61 and 62 are provided on each endless chain 69 at a predetermined pitch such that the first and second grip members 61 and 62 extend outward.

The first grip member 61 is formed of a spring-steel plate material that has a predetermined width and is bent in the shape of the numeral "2." The second grip member 62 is formed of a plate material that has substantially the same width as the first grip member 61 and is harder than the first grip member 61. The second grip member 62 is bent in the shape of the numeral "7." A stepped portion is formed at a central portion of the portion of the second grip member 62 corresponding to the longer leg of the "7," in order to increase the distance between the long leg and the short leg of the "7," and the portion located on the tip-end side of the stepped portion is bent slightly outward.

Contrary to the above-described structure, the second grip member 62 may be formed of an elastic material, and the first grip member 61 may be formed of a material harder than the second grip member 62. Alternatively, each of the first and second grip members 61 and 62 may be formed of an elastic material.

Further, a portion of at least one of the first and second grip members 61 and 62 may be formed of an elastic material and may be provided in such a manner as to cope with variation in the thickness of the signature 100.

The first and second grip members 61 and 62 may be formed of a material having a low elasticity, and at least one of the first and second grip members 61 and 62 may be attached to the endless chain 69 via an elastic member, so that variation in the thickness of the signature 100 is absorbed through action of the elastic member.

The first grip member 61 is provided on the endless chain 69 at predetermined intervals (every four links in the illustrated example) such that the lower base portion of the "2"-shaped first grip member 61 is fixed to the flange portion 69*e* of the outer link 69*b* and the head portion of the "2"-shaped first grip member 61 faces toward the traveling direction of the endless chain 69. The second grip member 62 is attached to the outer link 69*b* at the same intervals as those of the first grip member 61. Specifically, in the illustrated example, the shorter leg of the "7"-shaped second grip member 62 is attached to an outer link 69*b* offset by two chain pitches from the outer link 69*b* to which the first grip member 61 is attached, such that the longer leg of the "7"-shaped second grip member 62 extends toward a direction opposite the traveling direction of the endless chain 69. As a result, the tip end of the longer leg of the second grip member 62 reaches a position corresponding to the position of the head portion of the "2"-shaped first grip member 61 located on the upstream side with respect to the traveling direction of the endless chain 69.

On each of the arms 58*a*—which are substantially parallel to the endless chains 69 in a region between the first and second sprockets 51 and 52—are provided two chain support members 68 for supporting the traveling endless chain 69. That is, each of the chain support members 68 has an L-shaped cross section, and the longer side 68*b* thereof is fixed to the side surface of the corresponding arm 58*a* via an unillustrated bracket such that the chain support members 68 extend along the arm 58*a* and the shorter sides 68*a* of the chain support members 68 are opposed to each other under the arm 58*a*. The shorter sides 68*a* of the chain support members 68 support the opposite ends 69*f* of the pin 69*d* of the endless chain 69.

A signature guide member 81 is disposed in a space between adjacent fan members 33. The signature guide member 81 has a guide surface for guiding the signature 100—which has been released from the rollers 11 of the folding section 1 and is falling—to the signature receiving space 34 of the delivery fan 3 positioned under the rollers 11. Further, a signature end guide member 82 is provided outside the locus of the fan members 33 of the delivery fan 3 that rotate from the rollers 11 of the folding section 1 toward the transport conveyer 7. The signature end guide member 82 has an arcuate guide surface 82*a* substantially concentric with the locus of the fan members 33.

Next, there will be described the operation of the above-described signature-delivery-pitch regulating apparatus for the delivery apparatus of a folding machine.

A single piece of paper or a plurality of superposed pieces of paper (unillustrated) to be folded are inserted by the blade 12 into the clearance between the outer circumferential surfaces of the rollers 11, which rotate in opposite directions as indicated by arrows in FIG. 1. Thus, the paper is folded at the inserted portion into a signature 100. The signature 100 is passed through the clearance between the outer circumferential surfaces of the rollers 11 and is discharged downward a single signature at a time.

Figure 4A:
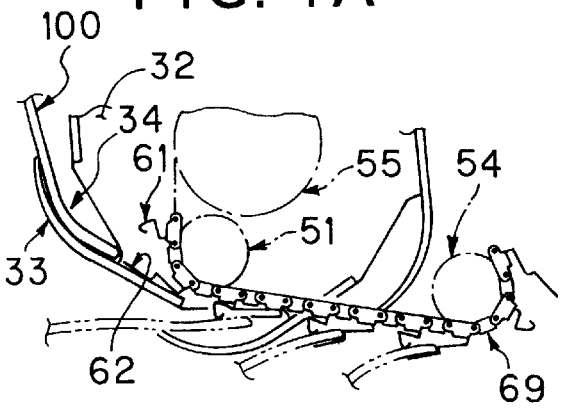
FIGS. 4A–4J are explanatory views each showing an operation state of a delivery fan and grip mechanisms of the signature-delivery-pitch regulating apparatus of FIG. 1.

Meanwhile, the rotary shaft 31 of the delivery fan 3 is rotated counterclockwise by the drive means (unillustrated). As a result, the six signature receiving spaces 34 of the delivery fan 3 are successively positioned such that the opening of one signature receiving space 34 faces the clearance between the outer circumferential surfaces of the rollers 11. At this time, the signatures 100 successively discharged from the roller 11 are guided by the signature guide members 81 to successively fall into the signature receiving spaces 34. The folded portion of the signature 100 is supported by the bottom 34*a* of the signature receiving space 34. (see FIG. 4A).

The rotational speed and rotational phase of the delivery fan 3 are adjusted so as to be synchronous with the timing of discharge of the signature 100 in the folding section 1 such that the signature 100 reliably falls into the signature receiving space 34.

With rotation of the delivery fan 3, the signature 100 received in the signature receiving space 34 is transported downward while its posture is changed to horizontal. When the signature 100 reaches the lowest position close to the transport conveyer 7, the folded front end portion becomes substantially parallel to the transport conveyer 7.

The signature 100—which is received in the signature receiving space 34 and is transported through rotation of the delivery fan 3—is longer than the fan members 33. Therefore, the end portion of the signature 100 projecting outward from the signature receiving space 34 moves while being in contact with the guide surface of the signature end guide member 82 and being pressed thereby. Accordingly, irregular motion, such as flapping, of the signature 100 is suppressed.

In the grip mechanism 5, through proper control and drive of the motor 67, the rotary shaft 54 is rotated via the belt transmission mechanism 66 with a predetermined relationship with the rotation of the delivery fan 3 for transporting the signatures 100.

When the rotary shaft 54 or the second sprockets 52 rotate counterclockwise in FIG. 1, the endless chains 56—which are wound around the second sprockets 52, the rotatable chain-tension sprockets 56, the intermediate sprockets 55, and the first sprockets 51—travel counterclockwise, while having a predetermined relationship with the rotation of the delivery fan 3.

When a certain portion of the endless chain 69 travels in straight travel regions between the first sprockets 51, the second sprockets 52, the chain-tension sprockets 56, and the intermediate sprockets 55, the relative relationship between the first and second grip members 61 and 62 provided at the certain portion of the endless chain 69 is changed such that the tip end of the longer leg of the "7"-shaped second grip member 62 comes into contact with the head portion of the "2"-shaped first grip member 61, and the first grip member 61 is bent slightly. That is, the first and second grip members 61 and 62 come into contact with each other with a proper spring force.

When the certain portion of the endless chain 69 travels in curved travel regions where the endless chain 69 is in meshing engagement with the first sprockets 51, the second sprockets 52, and the intermediate sprockets 55, the first and second grip members 61 and 62 provided at the certain portion of the endless chain 69 create the following relative relationship. That is, in such a curved travel region, an outer link 69*b* to which the first grip member 61 is attached and another outer link 69*b* to which the second grip member 62 is attached form a bent shape along the outer circumference of the first sprocket 51, the second sprocket 52, or the intermediate sprocket 55. Therefore, the tip end of the longer leg of the "7"-shaped second grip member 62 separates from the head portion of the "2"-shaped first grip member, so that the first and second grip members 61 and 62 are brought into an open state in which a predetermined clearance is formed between the first and second grip members 61 and 62 (see FIG. 4A).

Next, there will be described the positional relationship between the delivery fan 3 rotating counterclockwise in FIG. 1 and the endless chain 69 traveling counterclockwise in FIG. 1.

When the signature 100 received in the signature receiving space 34 is transported to the vicinity of the transport conveyer 7, while its posture is changed to horizontal, with rotation of the delivery fan 3, and the signature 100 reaches the lowest position where the folded front end portion becomes substantially parallel to the transport conveyer 7, the bottom 34*a* of the signature receiving space 34 of the delivery fan 3 must be positioned such that the position of the bottom 34*a* coincides with the opening between the opened first and second grip members 61 and 62 as viewed in a direction perpendicular to the sheet of FIG. 1. The positional relationship between the delivery fan 3 and the endless chain 69 is determined to satisfy such a requirement.

The signature 100 that has been transported through rotation of the delivery fan 3 and reached the vicinity of the transport conveyer 7 is inserted between the corresponding paired first and second members 61 and 62 and is gripped by the first and second members 61 and 62, so that the signature 100 is pushed out of the signature receiving space 34, which is also moving.

That is, the travel speed of the endless chain 69 or the moving speed of the first and second grip members 61 and 62 is set lower than the moving speed of the signature receiving space 34 of the delivery fan 3. Further, the disposition pitch of the paired first and second grip members 61 and 62 on the endless chain 69 is set smaller than the circumferential disposition pitch of the bottoms 34*a* of the signature receiving space 34 of the disk member 32.

However, there is a possibility that the fan member 33 of the delivery fan 3—whose position corresponds to those of the first and second grip members 61 and 62 in the curved travel regions of the endless chain 69—interferes with a signature 100 gripped by the first and second grip members 61 and 62 located ahead of the first and second grip members 61 and 62 that correspond to the fan member 33. In order to avoid such interference, the moving speed of the first and second grip members 61 and 62 and the disposition pitch of the first and second grip members 61 and 62 on the endless chain 69 are determined in consideration of the moving speed, the circumferential disposition pitch, and the shape of the fan members 33.

Figure 4C:
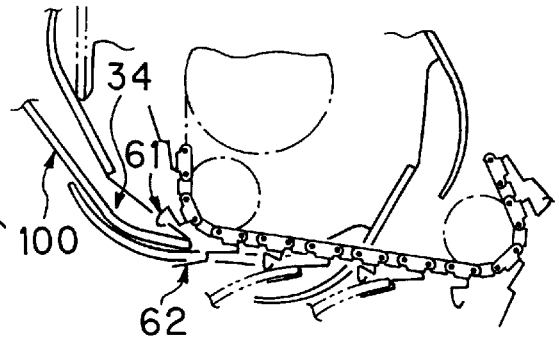
Figure 4B:
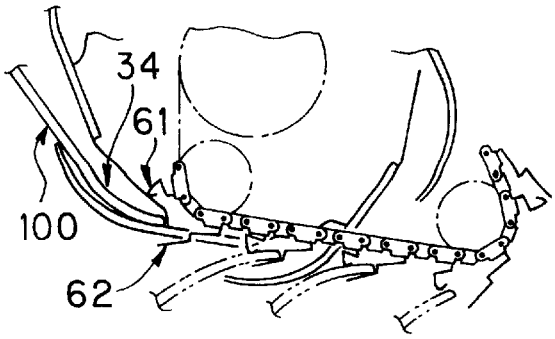
Figure 4D:
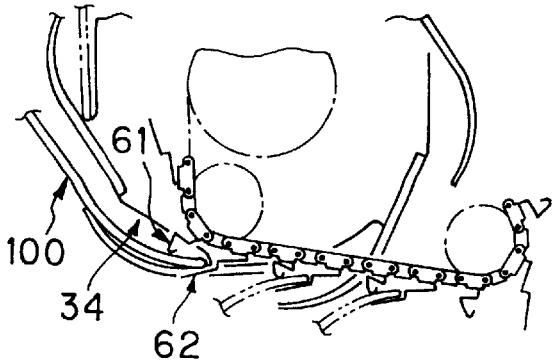
Figure 4E:
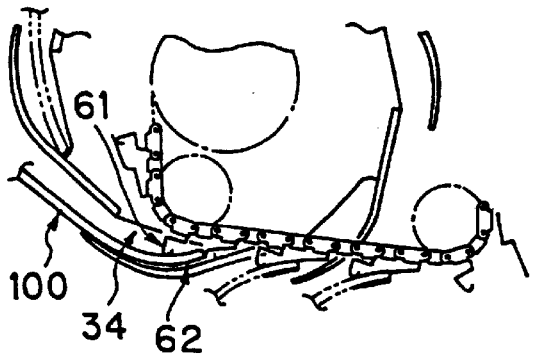
Figure 4H:
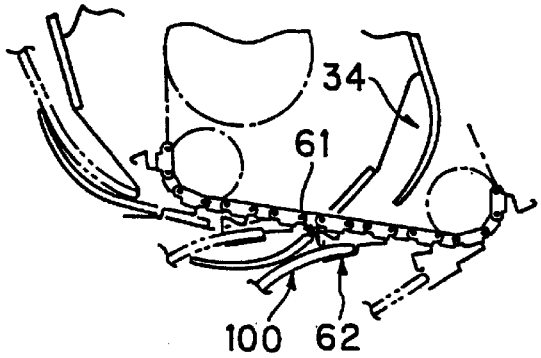
Figure 4F:
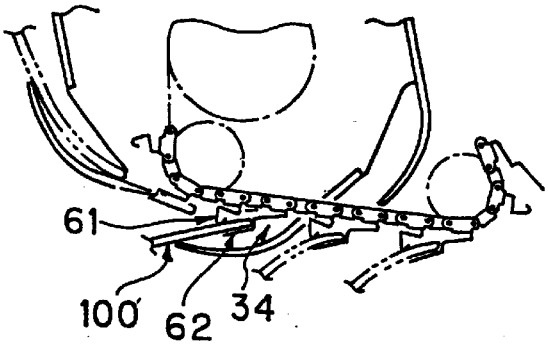
Figure 4I:
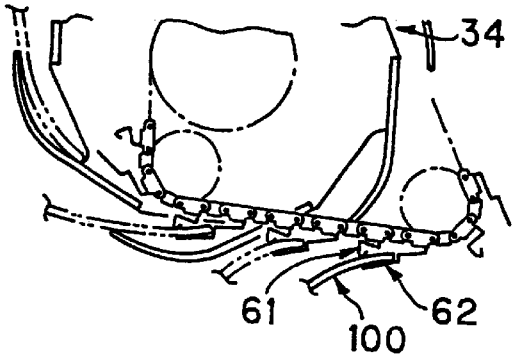
Figure 4G:
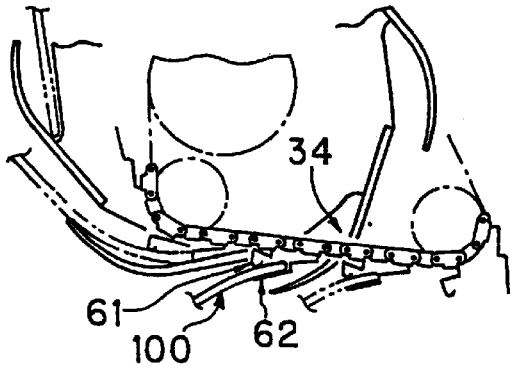

Thus, when the signature 100—which has been received in the signature receiving space 34 and transported downward through rotation of the delivery fan 3—reaches the lowest position, the folded front end portion of the signature 100 moves substantially parallel to the transport conveyer 7 and enters the space between the opened first and second grip members 61 and 62, which are located in the curved travel region where the endless chain 69 is in meshing engagement with the first sprocket 51. The folded front end portion of the signature 100 enters the space between the first and second grip members 61 and 62 until the folded end of the signature 100 abuts the stepped portion of the second grip member 62. (see FIGS. 4B, 4C, and 4D)

When the folded end of the signature 100 abuts the stepped portion of the second grip member 62, the signature 100 received in the signature receiving space 34 is positioned at a constant radial position, so that the overlap pitch of the signatures 100 on the transport conveyer 7 becomes constant.

At this time, the first and second grip members 61 and 62 into which the signature 100 has been inserted moves from the curved travel region to the straight travel region of the endless chain 69. Therefore, the head portion of the "2"-shaped first grip member 61 comes into contact with the tip end of the longer leg of the "7"-shaped second grip member 62 in order to grip the signature. Since the first and second grip members 61 and 62 move more slowly than the signature receiving spaces 34 of the delivery fan 3 by the above-described predetermined speed difference, the first and second grip members 61 and 62 push the signature 100 out of the signature receiving space 34 of the delivery fan 3. Subsequently, due to travel of the endless chain 69 in the straight travel region, the first and second grip members 61 and 62 transport the signature 100 substantially parallel to the transport conveyer (to the right in FIG. 1) (see FIGS. 4E, 4F, 4G, 4H, and 4I).

In this manner, the successive signatures 100 are gripped by the first grip members 61 and the second grip members 62 of the endless chain 69.

When a certain portion of the endless chain 69 travels in the straight travel region between the first and second sprockets 51 and 52, that portion tends to slack due to the weight of the signatures 100 gripped by the first and second grip members 61 and 62. If the endless chain 69 slacks and expands outward, the first and second grip members 61 and 62 tend to open, so that the state of gripping the signatures 100 becomes incomplete, resulting in a risk of dropping.

However, in the straight travel region between the first and second sprockets 51 and 52, the endless chain 69 moves in a state in which the opposite ends 69*f* of each pin 69*d* of the endless chain 69 are supported by the shorter sides 68*a* of the chain support members 68. Therefore, there can be prevented slack of the endless chain 69 which would otherwise occur due to the weight of the signatures 100, so that the proper gripped state of the signature 100 is maintained.

Figure 4J:
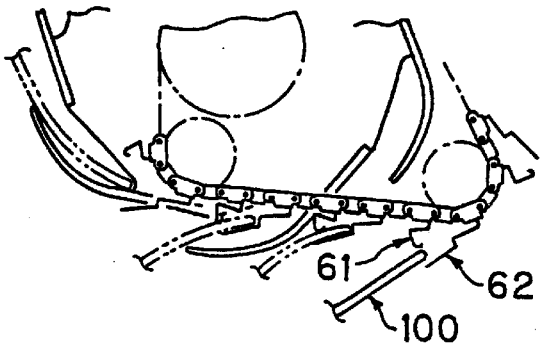

When with the travel of the endless chain 69 the first and second sprockets 51 and 52 gripping the signature 100 reach the curved travel region where the endless chain 69 is in meshing engagement with the second sprocket 52, the first and second grip members 61 and 62 are directed downward in an open state in which a predetermined clearance is formed between the first and second grip members 61 and 62. Thus, the signature 100 is released and drops on the transport conveyer 7 whose belt travels to the right in FIG. 1. The signature 100 drops onto the transport conveyer 7 such that the folded portion of the signature 100 is located on a preceding signature 100. (see FIG. 4J)

The transport conveyer 7 moves at a speed that has a predetermined relationship with the travel speed of the endless chain 69; i.e., at a speed such that the transport conveyer 7 moves to the right in FIG. 1 over a predetermined distance L that is shorter than the length of the signature 100, during a period between a point in time when a certain pair of first and second grip members 61 and 62 release a signature 100 and a point in time when the next pair of first and second grip members 61 and 62 release another signature 100.

Accordingly, when a preceding signature 100 is present on the transport conveyer 7, the next signature 100 is superposed on the preceding signature 100 while being shifted therefrom by a constant pitch L corresponding to the above-described distance L. Subsequently, the signatures 100 are transported to the right in FIG. 1 and delivered to the outside of the rotary press.

The shift pitch L of the signatures 100 aligned on the transport conveyer 7 can be freely changed through modification of the relationship between the travel speed of the endless chain 69 and the travel speed of the transport conveyer 7. That is, when the travel speed of the endless chain 69 is equal to the travel speed of the transport conveyer 7, the shift pitch L becomes substantially equal to the disposition pitch of the first grip members 61 on the endless chain 69, and the shift pitch L decreases as the travel speed of the transport conveyer 7 becomes increasingly slower than the travel speed of the endless chain 69.

Obviously, numerous modifications and variations of the present invention are possible in light of the above teachings. It is therefore to be understood that within the scope of the appended claims, the present invention may be practiced otherwise than as specifically described herein.

What is claimed is:

1. A signature-delivery-pitch regulating apparatus for a delivery apparatus of a folding machine of a rotary press, which delivery apparatus comprises a delivery fan which is adapted to receive signatures folded in a folding section at a plurality of signature receiving spaces while rotating; and a grip mechanism adapted to grip a signature in each signature receiving space, push the signature out of the signature receiving space, move toward a transport conveyer, and then release the signature on the transport conveyer, the transport conveyer operating at a speed that has a predetermined relationship with the moving speed of the grip mechanism, wherein said grip mechanism comprises;

at least one endless chain in meshing engagement with at least a first sprocket and a second sprocket, the first sprocket having a rotation center within a rotation locus of bottoms of the signature receiving spaces of the delivery fan and in the vicinity of a region where the delivery fan comes close to the transport conveyer, the second sprocket having an outer circumference located outside the rotation region of the delivery fan, and the endless chain being capable of traveling along the transport direction of the transport conveyer from a position inside the rotation region of the delivery fan to a position outside the rotation region of the delivery fan;

a plurality of first grip members provided on different links of the endless chain at a constant pitch;

a plurality of second grip members provided on the endless chain at a constant pitch such that each second grip member is located between the first grip members and fixed to a link different from the link to which the first grip member located on the upstream side with respect to the travel direction of the endless chain is attached, a free end of the second grip member being brought into contact with or separated from that upstream first grip member, so that the second grip member cooperates with the upstream first grip member to grip and release the signature; and drive means for causing the endless chain to travel at a speed slower than the circumferential speed of the delivery fan, while maintaining a predetermined relationship with the circumferential speed of the delivery fan, wherein the endless chain travels along a travel path which comprises a first curve portion in which the endless chain curves along the first sprocket, a second curve portion in which the endless chain curves along the second sprocket, and at least one intermediate portion between the first and second curve portions, and the second grip member, when located in the first and second curve portions, is open relative to the upstream first grip member, and when located in the intermediate portion, is closed relative to the upstream first grip member; and the first curve portion is located on the rotary locus of the bottoms of the signature receiving spaces of the delivery fan, so that, when the endless chain travels along the first sprocket, the second grip member opens relative to the first grip member, the opening being located on the rotary locus on the bottoms of the signature receiving spaces of the delivery fan; as the delivery fan rotates, the signature enters the space between the first and second grip members; and when the travel of the endless chain along the first sprocket ends, the second grip member is closed relative to the first grip member so as to grip the signature.

2. A signature-delivery-pitch regulating apparatus according to claim 1, further comprising a chain support mechanism for supporting the endless chain to thereby prevent downward slack in a region between the first and second sprockets where the endless chain travels along the transport direction of the transport conveyer.

3. A signature-delivery-pitch regulating apparatus according to claim 1, wherein at least one of the first and second grip members is supported on the endless chain via an elastic member, so that the signature can be gripped by the first and second grip members regardless of the thickness of the signature.

4. A signature-delivery-pitch regulating apparatus according to claim 1, wherein at least one of the first and second grip members is formed of an elastic material, so that the signature can be gripped by the first and second grip members regardless of the thickness of the signature.

5. A signature-delivery-pitch regulating apparatus according to claim 2, wherein at least one of the first and second grip members is supported on the endless chain via an elastic member, so that the signature can be gripped by the first and second grip members regardless of the thickness of the signature.

6. A signature-delivery-pitch regulating apparatus according to claim 2, wherein at least one of the first and second grip members is formed of an elastic material, so that the signature can be gripped by the first and second grip members regardless of the thickness of the signature.

* * * * *